United States Patent [19]

Kangas et al.

[11] Patent Number: 4,607,672

[45] Date of Patent: Aug. 26, 1986

[54] MULTI-PRODUCT WOOD PROCESSOR

[75] Inventors: Vernon W. Kangas, Calumet; Roy J. Kangas, Dodgeville; Edsel D. Matson, Hancock, all of Mich.

[73] Assignee: The United States of America as represented by the Secretary of Agriculture, Washington, D.C.

[21] Appl. No.: 696,566

[22] Filed: Jan. 30, 1985

[51] Int. Cl.[4] ..... B27C 9/00; B27C 1/00

[52] U.S. Cl. ..... 144/2 R; 83/333; 83/394; 144/49; 144/162 R; 144/172; 144/241; 241/92; 241/278 A

[58] Field of Search ..... 83/333, 334, 335, 336, 83/391, 394; 241/92, 278; 144/2 R, 3 R, 49, 162 R, 172, 193 R, 241

[56] References Cited

U.S. PATENT DOCUMENTS

| | | | |
|---|---|---|---|
| 3,190,326 | 6/1965 | Standal | 144/162 |
| 3,360,024 | 12/1967 | Traben | 144/176 |
| 3,461,931 | 8/1969 | Wexell | 144/162 |
| 4,135,563 | 1/1979 | Maucher | 144/323 |
| 4,311,175 | 1/1982 | Drummond | 144/241 |

*Primary Examiner*—W. D. Bray

*Attorney, Agent, or Firm*—M. Howard Silverstein; David G. McConnell

[57] ABSTRACT

An improved wood processing apparatus which prevents clogging or fouling of the apparatus by providing a clear opening in the base of the apparatus for the passage of the pieces once cut, this area directing the pieces by gravity away from the drive mechanism. Additionally, the fully enclosed nature of the cutting hole eliminates the possibility of logs of too large a section being inserted into the cutting drum thereby stalling or fouling the cutting drum action.

12 Claims, 5 Drawing Figures

MULTI-PRODUCT WOOD PROCESSOR

FIELD OF THE INVENTION

The present invention relates to a multi-product wood processor for cutting small-diameter trees into chips, chunks or pieces for domestic firewood. The invention more particularly relates to an apparatus for reducing small diameter trees to pieces of varying sizes.

BACKGROUND OF THE INVENTION

There is increased interest in the ability to reduce small diameter trees, branches, logging residue and the like to pieces of usable size as for example for use as pulp in paper manufacture, chunk size for firing boilers and for flake boards and also in the production of firewood or fuel wood. Prior art devices have concentrated on the utilization of disc-type cutting devices which reduce a log to chips or prepare a log for further use as in lumber.

U.S. Pat. No. 3,190,326 to Standal discloses an invention for squaring logs in preparation for sawmill processing. The logs are fed in a radial way while a circular multi-bladed wheel spins to cut the log into chips.

U.S. Pat. No. 3,360,024 to Traben discloses a multi-bladed chipping device which is radially presented to a log. The device is utilized for squaring a log for sawmill processing at a later time.

U.S. Pat. No. 3,461,931 to Wexell describes a wood chipping device which utilizes holes in which chipping blades have been mounted so that a log which has been presented in an axial way to the cutting machine may be reduced to chips. The cutting chamber itself is conical thereby progressively reducing the diameter of the log presented as the log is reduced to chips.

U.S. Pat. No. 4,135,563 to Maucher discloses an apparatus for chipping logs in which the logs are presented in an essentially radial manner to a drum-type chipping device in which the blades have been mounted on a spinning drum.

U.S. Pat. No. 4,311,175 to Drummond discloses a log-chipping apparatus in which the logs are presented in an axial manner to a plate which is rotating and which bears the chipping tools.

Among the problems inherent in prior art logging chipping devices is that they will tend to jam when presented with too large a log, thus requiring dismantling or at least time consuming work to extract the oversized jammed log from the machine, during which time no processing can proceed. Additionally, a number of the prior art devices have the problem of having the power source mounted adjacent to or below the point of chipping, the chips produced may then fall into the mechanical apparatus causing fouling of the drive apparatus.

Therefore, here is a need for an improved wood chipping apparatus which will avoid the problems of jamming when presented with an oversized log and which will maintain the drive equipment at such a location that it will not be fouled by the falling chips of wood. Additionally, it is desirable to have an apparatus which will produce wood products of varying sizes depending upon the ultimate use to be made of products. Prior art machines are not versatile in that they produce a single size chip under any set of circumstances and would need new blades in order to produce a different size chip. Therefore, there is a need for a wood severing apparatus in which the size of the pieces to which a log is reduced may be varied at will without major reconstruction of the machine.

SUMMARY OF THE INVENTION

The present invention is a wood severing apparatus for reducing a log to pieces in which a log is presented in a radial fashion to a rotatable cylindrical drum which bears cutting holes with cutting blades along the trailing edge of each hole. The drum is rotated in such a way that the hole passes the stationary log which is held in an anvil prior to the blade passing the end of the log. The log then penetrates the hole by an adjustable amount and the blade shears off the amount of log that has been passed through the hole.

Stops may be provided behind the hole which will control the length of log which may be passed therethrough to be cut off by the blade. The anvil fixedly mounted on the base of the machine holds the log in a stationary position relative to the rotating drum.

BRIEF DESCRIPTION OF THE DRAWINGS

The best mode contemplated in carrying out this invention is illustrated and better understood by reference to the following detailed description when considered in connection with the accompanying drawings in which.

DETAILED DESCRIPTION OF THE PREFERRED EMBODIMENT

Figure 1:
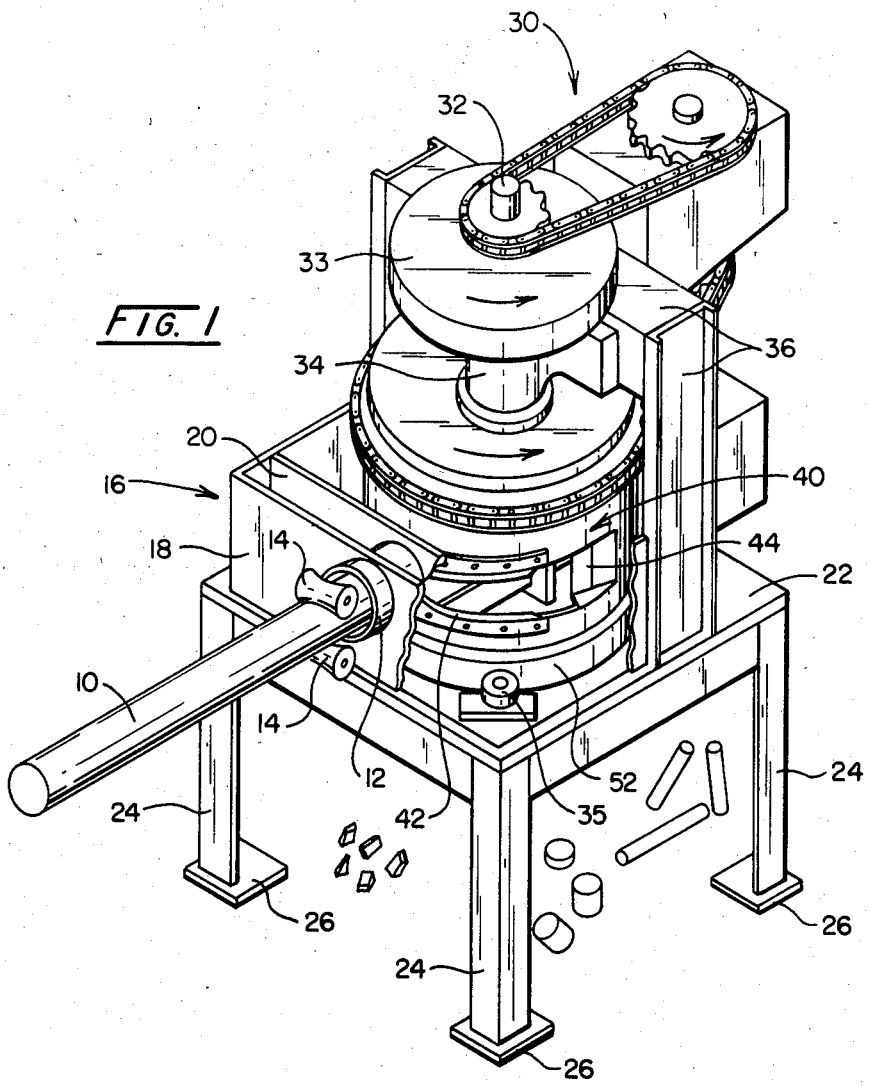
FIG. 1 is a perspective view of an apparatus according to the present invention including a cylindrical drum.

With reference to the drawings, FIG. 1 depicts the entire assembly of a log severing device according to the present invention. A log 10 has been inserted into an anvil 12. The log is guided into the circular-shaped anvil by means of roller mechanism 14. The anvil 12 is fixedly attached to a base assembly 16 which is configured to retain the anvil in relatively stationary position against the very high forces of cutting to which the log 10 will be subjected. Anvil 12 is preferably a section of circular pipe which penetrates a pair of plates 18 and 20. Since plates 18 and 20 are spaced apart, the anvil 12 is maintained laterally and also rotationally against the forces to which it will be subjected.

The base assembly 16 additionally comprises a base plate 22 which supports the entire structure. Legs 24 are disposed at the corners of base plate 22 and provide the appropriate elevation for the entire device which is mounted on top of base plate 22. The legs 24 additionally have support plates 26 by which means the entire assembly may be supported on the ground or bolted to the floor. A motor drive mechanism 30 is generally shown which comprises a motor and chain or belt drive to a shaft 32. It will be appreciated that the means for driving shaft 32 may vary and there is no preferred way of transmitting the power. The power may also be directly transmitted by an axially mounted power supply rather than a chain or belt driven side mount supply.

Figure 5:
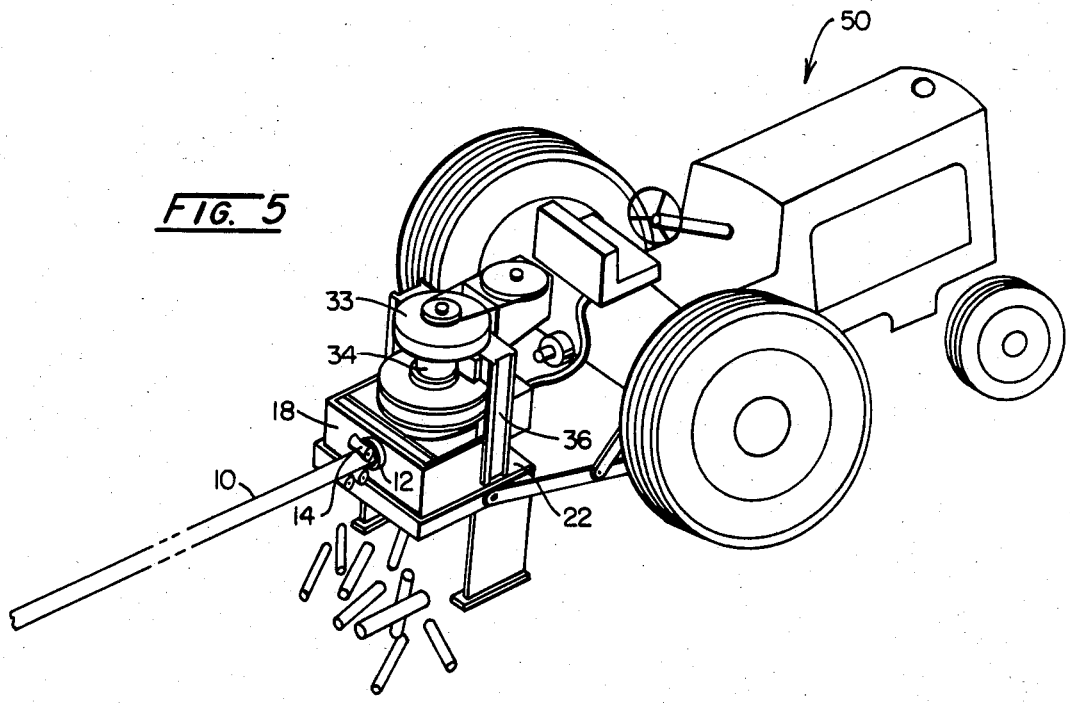
FIG. 5 is a perspective view of the apparatus of FIG. 1 mounted to accept a driving force from a tractor.

One specific example of a power supply is illustrated in FIG. 5. The power take-off from a tractor 50 is conventional and need not be described here.

Rotational shaft 32 is vertically disposed and supported by bearings 34 which are mounted on a structural support 36 which is itself rigidly connected to base support plate 22. Guide rollers 35 are provided at the side of the drum rigidly mounted to support plate 22, only a single bearing configuration being illustrated. Mounted upon rotational shaft 32 is cutter drum 40 defined by a wall which is preferably a cylindrical section in which one or more cutter holes have been placed.

Figure 3:
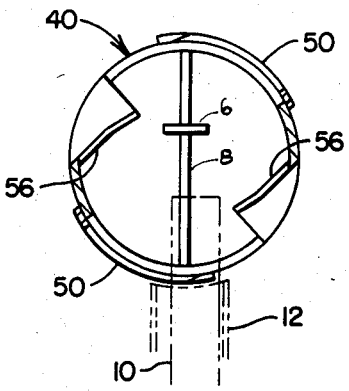
FIG. 3 is a plan sectional view taken along line 3—3 of FIG. 2.

The shape of the cutter holes is not critical but a generally rectangular shape has been illustrated in the cylindrical drum 40. The critical part is to have a leading section to admit logs and a trailing section to sever the inserted logs. Teardrop-shaped blades 42 are mounted at the trailing edge of the cutter hole. The direction of rotation of the drum 40 is such that the larger diameter portion of the teardrop-shaped cutter hole passes the anvil before the smaller diametered portion passes the anvil. This teardrop shape results in generally equal and opposite cutting forces which balances the stress on cylinder 40. The teardrop shape of the blades is not critical; they could be V-shaped or a single, diagonally extending blade could span the opening in some way; alternative blade shapes need not be illustrated because all are within the inventive concept. Additionally, mounted within the cutter holes, immediately behind the cutter opening, are stops 44 which are adjustable to control the length of log 10 to be inserted within the hole prior to it being sheared off by the blades 42. Adjustment of stops 44 may be by a hinge or other means. An alternative stop for controlling the length of the cut piece is best seen in FIG. 3 where a sliding block is mounted on a bar bisecting the drum interior. Where there are two diagonally opposed cutter openings and it is desired that the log be cut to a length less than one-half the diameter of the drum, plural stops would be required.

In operation, the cutter drum 40 is rotated by rotational force being imparted to rotational shaft 32, and at the same time log 10 is inserted through the roller means 14 and further through the anvil 12 and into contact with cutter drum 40. Each time the cutter hole passes the log, the log will advance into the cutter hole, and as the cutter drum continues to rotate, the log 10 will be sheared by the action of the blades 42 in the smaller diameter portion of the cutter hole shape. The cut chips, chunks or pieces of wood then drop through the bottom of cutter drum 40 and through a clear hole in base support plate 22.

Figure 2:
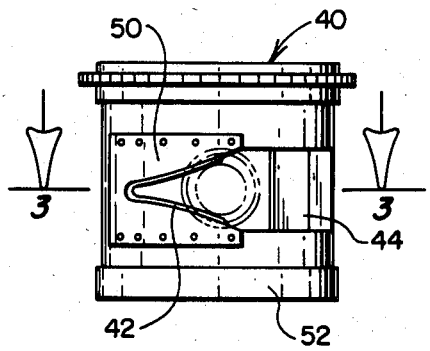
FIG. 2 is a side elevational view of the cylindrical drum of FIG. 1.

Turning now to FIG. 2 which is a side elevational view of drum 40, it can be seen that cutter blades 42 are borne on the edges of a reinforced plate 50 which is a removable plate assembly thereby allowing replacement and renewal of cutter blades 42. Blades formed on the trailing edge of the cutter hole rather than as a separate piece are within the inventive concept. Plate 50 is removably attached to the perimeter surface of drum 40. Drum 40 also bears a bearing ring 52 at its lower extremity and this bearing ring engages the rollers 35 thereby providing alignment for the drum 40 during rotation.

Turning now to FIG. 3 which is a plan sectional view taken along line 3—3 of FIG. 2, it can be seen that an access ramp 56 is provided just inside the drum surface. The ramp 56 is inclined inwardly from the drum surface to provide a smooth entry of the log into the drum. Additionally, this provides a strengthening position for the drum at a point of high stress during cutting.

In order to provide continuity of cutting, a fly wheel 33 is provided on the shaft 32 in the area above drum 40. In one embodiment of the invention a fly wheel assembly includes the sprocket and fly wheel 33 integral with a bearing, which bearing engages (but is not attached to) the periphery of the drive shaft 32. The fly wheel will tend to smooth out the pulsing type of force inherent to the cutting or chipping action of the log chipping machine and will aid in the production of uniform sized chips, chunks or pieces.

Figure 4:
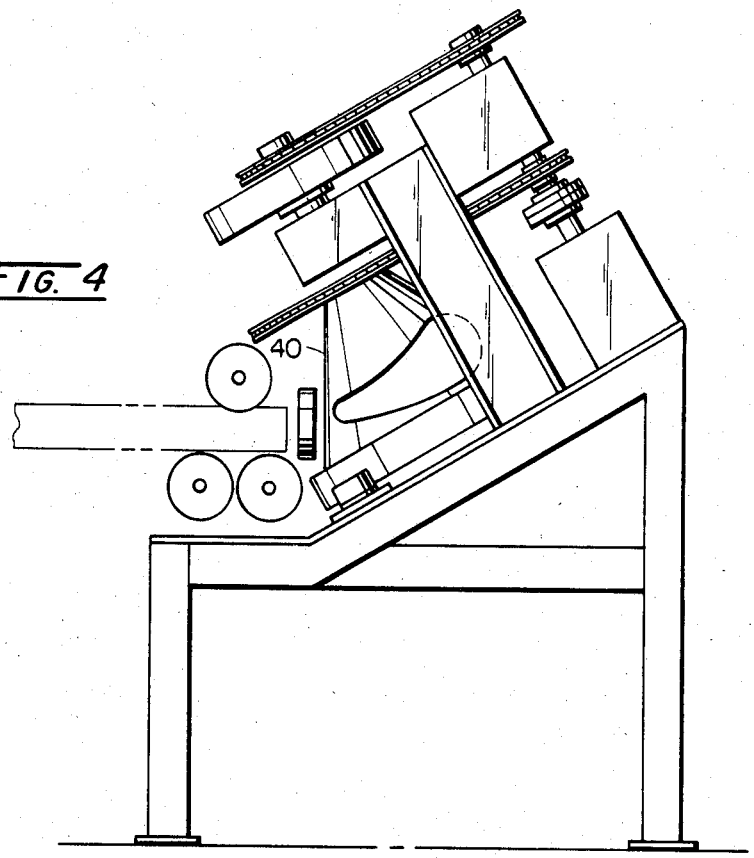
FIG. 4 is an alternative embodiment of the apparatus of FIG. 1 but including a cone shaped drum.

FIG. 4 illustrates an alternative embodiment wherein the rotating drum 40 is cone shaped rather than cylindrical. The operation is identical so no additional explanation appears necessary. Theoretically, the resulting wood piece could be of infinite length because the inserted log does not have the possibility of engaging the opposite side of the cutting drum. As indicated previously in relation to the cylindrical cutting drum, the shape of the cutting blades is not critical.

It will be apparent from the above description that the present invention provides for an improved wood chipping apparatus which is inherently non-clogging. The chips, chunks or pieces will fall through a hole in the bottom of the device without having to pass the drive mechanisms, and additionally, the fully enclosed cutting area or hole inherently produces a situation in which only logs and tree segments up to but not exceeding the maximum size capabilities of the machine may be inserted into the cutting device in the first place.

The above "Detailed Description of the Invention" and "Summary" describes an apparatus for reducing the size of logs. It is understood that it is also within the scope of the invention to utilize wood pieces such as small diameter trees, branches, and logging residues. The resulting products are, by adjusting the stops, of varying size such as conventional wood chips for pulp, chunk size for firing boilers and the like, and firewood size pieces.

With further regard to FIG. 3., stop 6 is a sliding block mounted on bar 8. Bar 8 is attached to base plate 22 underneath drum 40 and does not rotate with drum 40. It is also understood that stop 44 is adjustably attached to ramp 56.

Having thus described the invention, what is claimed is:

1. An apparatus for reducing the size of wood pieces comprising:

a hollow drum defined by a wall;

means to rotate said drum;

means on said drum defining an aperture in said wall, wherein a first segment of said aperture defines an area large enough to permit a wood piece to extend therethrough into the interior of said drum, and wherein a second segment of said aperture includes a blade to cut into said wood piece as said drum rotates.

2. The apparatus of claim 1 wherein said second segment defines a V-shaped blade.

3. The apparatus of claim 1 wherein said aperture defines an elongated opening extending around the drum.

4. The apparatus of claim 3 wherein said first segment is located at one end of said elongated opening, and said second segment is located at the opposite end.

5. The apparatus of claim 4 wherein said opposite end defines a V-shaped blade.

6. The apparatus according to claim 1 wherein said drum is rotated by a driven shaft.

7. The apparatus according to claim 1 further comprising a flywheel circumscribing said drive shaft.

8. The apparatus according to claim 1 wherein said drum further comprises a ramp adjacent each cutting area for guiding the log into the cutting area.

9. The apparatus according to claim 8 further including a stop to prevent the log from entering the cutting area greater than the desired distance.

10. The apparatus according to claim 9 wherein said stop is movably attached to said ramp to adjust the desired distance of log entry.

11. The apparatus according to claim 1 wherein said blade is a removably attachable plate mounted on said drum.

12. The apparatus according to claim 1 wherein the plane of rotation of said drum is horizontal, wherein the means for rotating said drum is located above said drum, and the interior of said drum is open at the bottom so that chips, chunks or pieces of log may fall from said drum by gravity.

* * * * *